United States Patent [19]

Piana

[11] Patent Number: 4,471,689

[45] Date of Patent: Sep. 18, 1984

[54] DISPOSABLE CARTRIDGE FOR USE IN BEVERAGE EXTRACTING AND DISPENSING MACHINES

[75] Inventor: Giuseppe S. Piana, Milan, Italy

[73] Assignee: Unoper S.R.l., Gattinara, Italy

[21] Appl. No.: 344,844

[22] Filed: Feb. 1, 1982

[30] Foreign Application Priority Data

Feb. 3, 1981 [IT] Italy ..... 19472 A/81

[51] Int. Cl.[3] ..... A47G 19/16; B65D 85/00

[52] U.S. Cl. ..... 99/295; 426/77; 426/433; 426/435; 426/112; 426/506; 422/282; 422/283

[58] Field of Search ..... 426/77–80, 426/433, 435, 112, 506; 422/279, 288, 283, 282, 266, 261; 99/295

[56] References Cited

U.S. PATENT DOCUMENTS

| | | | |
|---|---|---|---|
| 580,303 | 4/1897 | Bailey | 422/283 |
| 842,088 | 1/1907 | Elfreth | 422/282 |
| 1,173,365 | 2/1916 | McComb | 422/283 |
| 2,419,845 | 4/1947 | Merrick | 422/283 |
| 2,604,446 | 7/1952 | Palmer | 422/283 |
| 2,735,718 | 2/1956 | Robinson | 422/283 |
| 2,778,739 | 1/1957 | Rodth | 99/295 |
| 2,939,381 | 6/1960 | McBridge | 99/295 |
| 2,968,560 | 1/1961 | Goros | 99/295 |
| 3,083,100 | 3/1963 | Baran | 99/295 |
| 3,195,985 | 7/1965 | Elkin | 422/283 |
| 3,266,870 | 8/1966 | Cianflone | 422/283 |
| 3,719,505 | 3/1973 | Mazza | 99/295 |
| 3,975,996 | 8/1976 | Vitous | 99/295 |
| 4,052,037 | 10/1977 | Mair et al. | 426/86 |
| 4,136,202 | 1/1979 | Favre | 99/295 |
| 4,250,911 | 2/1981 | Kratz | 422/282 |
| 4,339,332 | 7/1982 | Jasperson | 422/282 |

FOREIGN PATENT DOCUMENTS

| | | | |
|---|---|---|---|
| 2151636 | 5/1972 | Fed. Rep. of Germany | 99/295 |
| 1566089 | 5/1969 | France . | |
| 2022482 | 7/1970 | France . | |
| 2160634 | 11/1972 | France . | |

*Primary Examiner*—Steven L. Weinstein

*Attorney, Agent, or Firm*—Sughrue, Mion, Zinn, Macpeak and Seas

[57] ABSTRACT

A disposable cartridge comprises a substantially rigid envelope of plastics material which contains a dose of water-soluble granular, powdery or similar particulate matter adapted to produce a beverage by brewing with hot water. The envelope has an inlet endwall with one or more water inlet through holes close to, and radially inside a peripheral region thereof, the inlet end-wall being otherwise imperforate. The envelope has an opposite outlet endwall which has, within the envelope, a substantially axial tubular appendage which extends from the inner face of the outlet wall towards the inlet wall and which defines a beverage outlet conduit with an intake orifice near the inlet wall and an out-flow orifice in the outer face of the outlet wall.

3 Claims, 4 Drawing Figures

DISPOSABLE CARTRIDGE FOR USE IN BEVERAGE EXTRACTING AND DISPENSING MACHINES

BACKGROUND OF THE INVENTION

This invention relates to disposable cartridges for use in beverage extracting and dispensing machines.

More particularly, the invention relates to a disposable cartridge comprising a substantially rigid envelope of plastics material which contains a dose of water-soluble granular, powdery or similar particulate matter adapted to produce a beverage by brewing with hot water, wherein the envelope consists of a substantially cylindrical hollow body having an imperforate sidewall, a perforate inlet endwall and an opposite perforate endwall, the inlet endwall being adapted to be sealingly engaged, on a peripheral region thereof, by an infeed element of a brewing machine, which element has means from which hot water under pressure can be flowed onto and through said inlet wall and into the envelope, and the outlet endwall being adapted to be engaged by an opposite drain element of the brewing machine, which element has means through which the beverage flowing out from the envelope through its outlet wall can be dispensed.

STATEMENT OF PRIOR ART

Disposable cartridges of the above-said kind are known for example from German Patent Specification No. 1,196,131. Another cartridge of this kind, made of plastics material, is also disclosed in published European patent application No. 0041931 (corresponding to U.S. Ser. No. 272,240 filed June 10, 1981, now U.S. Pat. No. 4,389,925).

In the known cartridges the inlet endwall has an array of a multitude of perforations or holes, or a grid-like structure to allow hot water under pressure to flow into the envelope and allow the beverage to flow from the envelope practically all over the respective endwalls. Known cartridges of this kind are quite suitable in the case of granular or particulate matters, such as ground coffee, from which aromatic beverages are obtained by a percolation or infusion process in which hot water dissolves essential oils which are contained in the particles, while the particles themselves remain undissolved. During the percolation or infusion the hot water flows through a myriad of meanders or very restricted and tortuous paths. The efficiency of the process is favoured by the fact that the water flow through the matter takes place at relatively low velocities notwithstanding the high pressure difference across the cartridge. The efficiency remains high from the beginning to the end of the process, due to the fact that the meander network is not destroyed by dissolution or removal of the particles.

However, known cartridges of the above kind are not very suitable in the case of freeze-dried or other water-soluble products, such as freeze-dried tea, coffee, broth, etc. In this case, when hot water under pressure rushes into the cartridge through the numerous apertures or holes in its inlet wall, it forms corresponding water jets which are directed to the opposite endwall. The jets mainly dissolve the particles they meet in front of them and may "pierce" preferential channels in the product. It may happen that the water jets find their way, through the channels, to the opposite outlet endwall without having penetrated and thus dissolved the particles around the channels. This may result in a poor beverage due to the fact that a proportion of the product may remain in the cartridge at the end of the brewing cycle.

OBJECT OF THE INVENTION

The invention has for its object to provide a cartridge of the above-said kind, by which the above drawbacks are avoided.

SCOPE OF THE INVENTION

According to the invention this object is attained by a cartridge of the above-said kind, characterised in that said inlet wall has one or more water inlet through holes close to, and radially inside said peripheral region thereof, said inlet endwall being otherwise imperforate, and said outlet wall has, within the envelope, a substantially axial tubular appendage which extends from the inner face of the outlet wall towards the inlet wall and which defines a beverage outlet conduit having an intake orifice near the inlet wall and an outflow orifice in the outer face of the outlet wall.

In a cartridge according to the invention, the hot water under pressure which rushes into the envelope through the or each peripheral inlet hole forms a water jet which, even if it reaches the opposite endwall, is not allowed to immediately flow out of the cartridge, since the latter endwall is imperforate. The water stream is thus reflected back in the envelope and has to follow a relatively long path before it reaches the orifice of the outlet conduit. In practice, the or each water jet is ruptured when or before it reaches the opposite endwall and widely diffuses in the envelope. As a result, all the water-soluble matter contained in the envelope is easily removed and dissolved by the hot water in its path towards the outlet conduit.

Preferably, said or each said inlet through hole has an axis which lies in a chordal plane of the envelope and which makes an angle of less than 45° with respect to a diametral plane of the envelope, said diametral plane being substantially normal to said chordal plane.

Thus, the water jet which rushes into the envelope forms a centripetal whirl with a consequent beneficial increase of the length of the water path. Moreover, the centripetal whirling stream exerts a stirring effect which contributes to thoroughly mix blends of powdery or granular matters, such as blends of powdered cocoa and powdered milk for the preparing of hot chocolate beverage.

A preferred embodiment of the invention will now be described with reference to the attached drawings.

DRAWINGS

FIG. 1 is a perspective view of a disposable cartridge according to the preferred embodiment, FIG. 2 is a diametral cross-sectional view taken along the line II—II of FIG. 1, FIG. 3 is a plan view from below of a lid part of the cartridge of FIGS. 1 and 2, and FIG. 4 is a fragmentary cross-sectional view in an enlarged scale, taken along the line IV—IV of FIG. 2.

DESCRIPTION OF THE PREFERRED EMBODIMENT

Figure 1:
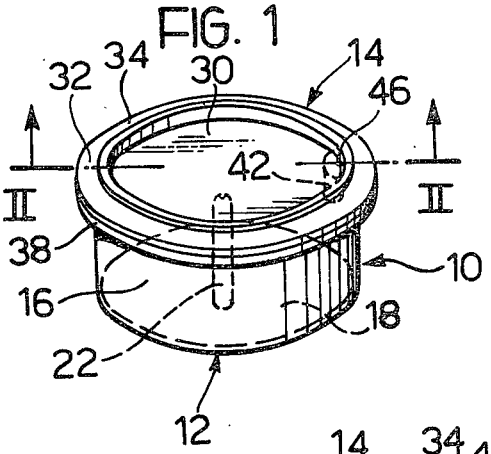
Figure 2:
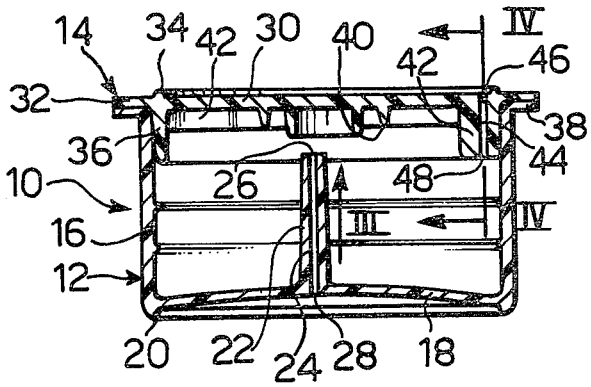

Referring now to FIGS. 1 and 2, a disposable cartridge is shown which comprises a hollow body or envelope, generally indicated by 10. The hollow body 10 has a substantially cylindrical shape. In the embodiment shown, the hollow body has a flattened round shape and is adapted to contain an individual dose of a water-soluble granular, powdery or particulate matter adapted to produce a single glass or a cup of beverage. However, the envelope 10 could contain an amount of water-soluble matter adapted to produce more than one glass or cup of beverage at the same time.

The hollow body 10 comprises a cup part, generally indicated by 12, and a lid part, generally indicated by 14. Both the parts 12, 14 are economically made of a substantially rigid plastics material adapted for use with foodstuffs.

The cup portion 12 has a substantially cylindrical imperforate sidewall 16 which constitutes the sidewall of the envelope 10, and a slightly outwardly concave bottom wall 18 which constitutes an outlet endwall of the envelope 10. The bottom wall 18 is bordered by a longitudinally projecting annular rib 20, whose function will be explained below.

The bottom wall 18 has an integral tubular appendage 22. The tubular appendage 22 extends in the envelope 10 close to, or along its centerline from the inner face of the bottom wall 18 to a point near the inner face of the lid part 14.

The appendage 22 has an axial outlet conduit 24 therein. The conduit 24 has an intake orifice 26 at the free end of the appendage 22 and an outflow orifice 28 on the outer face of the bottom wall 18.

The bottom wall 18 is imperforate, except for the outflow orifice 28.

Figure 3:
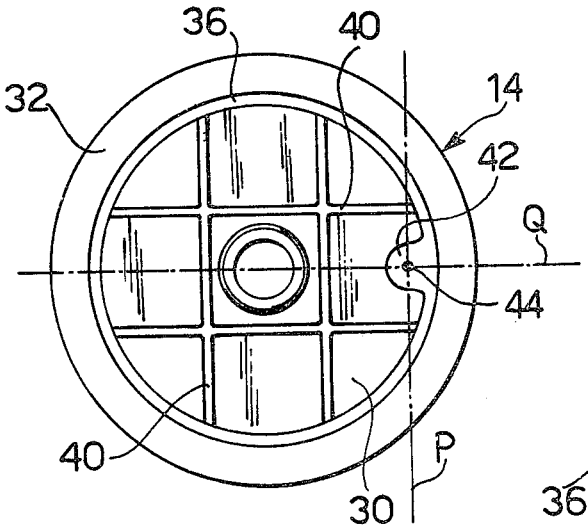

Referring now to FIGS. 1 to 3, the lid part 14 has a circular flat wall 30 which constitutes an inlet endwall of the envelope 10. The outer face of the flat wall 30 is bordered by a peripheral annular flange 32 having a raised annular portion or rib 34 whose purpose will be better explained below. The lid part also includes a peripheral skirt 36, formed integral therewith. The skirt 36 is sealingly fitted into the sidewall 16 of the cup part 12.

The annular flange 32 of the lid part 14 snugly rests on a corresponding annular flange 38 integrally formed with the upper edge of the sidewall 16 of the cup part 12.

A network of reinforcing ribs 40 is found on the inner face of the flat wall 30 to increase the rigidity of the wall 30.

The skirt 36 of the lid part 14 has a thickened peripheral portion in the form of a boss 42 of substantially half-cylindrical cross section on the radially inner surface of the skirt 34.

Figure 4:
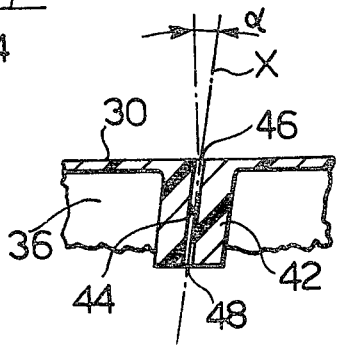

The boss 42 has formed therein a bore or conduit 44, as better shown in FIG. 4. The bore 44 has an intake orifice 46 which opens in the outer face of the inlet endwall 30, close to the annular rib 32 and radially inside with respect to the latter. The bore 44 ends in the inner space of the envelope 10 with an outflow orifice 48 which is situated at a slightly lower level with respect to the intake orifice 26 of the outlet conduit 22.

The axis X (FIG. 4) of the bore 44 lies in a chordal plane indicated by the dash-and-dot line P in FIG. 3. In this plane P, the axis X of the bore 44 makes an angle $\alpha$ (FIG. 4) with a diametral plane indicated by the dash-and-dot line Q in FIG. 3. The plane P is substantially normal to the plane Q.

The angle $\alpha$ is of less than 45° and preferably has a value of 5° to 15°.

A cartridge as described and shown is adapted to be used in a beverage extracting and dispensing machine such as that of U.S. patent application Ser. No. 272,240, filed June 10, 1981, now U.S. Pat. No. 4,389,925, which is here incorporated by reference.

A cartridge for the use in such machine and destined to contain an individual dose of product such as freeze-dried tea for preparing an individual cup of tea may have an inner volume of about 16 to 17 $cm^3$, an inner diameter of about 33 mm and a single inlet hole 44 at a distance of about 14.5 mm from the centre line of the envelope 10 and making an angle $\alpha$ of 9°. A suitable diameter of the inlet hole or bore 44 in this case has been found to be of about 0.8 mm to receive an inflow of hot water at a temperature of 80°–90° C. under a pressure of about 8 to 9 bar. The cross-sectional area of the outlet conduit 24 is not critical, but in any case it should have a diameter greater than that of the inlet hole 44.

Machines of the above kind have a lower plate or a similar element on which the cartridge may be rested with its lower wall or better with its sealing rib 20. The machine has an upper brewing head with a movable clamping plate or similar element which may be lowered to firmly engage the upper endwall or better the annular rib 34 of the cartridge. When the cartridge is clamped between the lower and upper plates of the machine, the ribs 20, 34 are in sealing engagement with the respective plates.

The upper plate has an orifice or other means through which hot water under pressure can be rushed onto the inlet wall 30. The hot water then rushes into the envelope 10 through the inlet bore or conduit 44.

The hot water introduced into the envelope 10 has then to find its way to the intake orifice 26 of the outlet conduit 24. The path which the hot water stream has to follow within the envelope 10 is rather long and in any case it is not a direct path, since the outflow orifice 48 of the inlet conduit 44 is located relatively far from the intake orifice 26 of the outlet conduit 24.

Due to the inclination of the inlet conduit 44, the water jet which rushes into the envelope 10 therefrom has a tangential component. The water stream is thus compelled to whirl in the envelope 10, that is to make a great deal of revolutions before it reaches the orifice 26. In this manner the water stream is able to dissolve and "wash away" all the soluble matter contained in the envelope 10.

The beverage so obtained discharges through the outflow conduit 24. The lower plate of the brewing machine has an outlet conduit or other outlet means to dispense the beverage from the region bounded by the sealing rib 20 between the lower or outlet wall 18 and the corresponding face of the plate.

The invention shall not be deemed as restricted to the embodiment shown. The inlet endwall of the envelope could have more than one inlet through hole close to its peripheral region although the provision of a single through hole as shown in 44 seems to be preferable. The plurality of through holes should be preferably distributed in a regular manner along the periphery of the inlet wall.

I claim:

1. A disposable cartridge for use in a beverage making machine of the type having an upper plate with a fluid inlet and a lower plate with a fluid outlet between which the cartridge is capable of being clamped comprising a substantially rigid, hollow, cylindrical body of plastics material having an imperforate side wall and an integral outlet end wall having an annular imperforate surface surrounding a centrally located hollow tubular appendage extending into said hollow cylindrical body parallel to said side wall and an inlet end wall adapted to be sealingly engaged with said side wall and having a boss extending into said body with a single inlet conduit comprised of an elongated bore extending therethrough adjacent said side wall, said hollow tubular appendage defining an outlet conduit having a single intake orifice disposed in closely spaced relation to said inlet end wall and having an outflow orifice in the outer surface of said outlet end wall wherein the end of said inlet conduit within said body is spaced from said inlet end wall a greater distance than said intake orifice of said outlet conduit.

2. A disposable cartridge as set forth in claim 1 wherein said inlet conduit has an axis which lies in a chordal plane of the cylindrical body and which makes an angle of less than 45° with respect to a dimetral plane of said body, said diametral plane being substantially normal to said chordal plane.

3. A disposable cartridge as set forth in claim 2 wherein said angle is in the range of 5° to 15°.

* * * * *